US005941416A

United States Patent [19]

Balz et al.

[11] Patent Number: 5,941,416

[45] Date of Patent: Aug. 24, 1999

[54] FLUID MIXING AND DISPENSING SYSTEM

[75] Inventors: Eric Balz; Eric Padelford; John Rolando, all of Greensboro, N.C.; John Thomas, River Falls, Wis.; Dan Boche, deceased, late of Eagan, Minn., by Sandy Boche, heir

[73] Assignee: Kay Chemical Company, Greensboro, N.C.

[21] Appl. No.: 08/960,523

[22] Filed: Oct. 31, 1997

[51] Int. Cl.[6] ..... B67D 5/52

[52] U.S. Cl. ..... 222/1; 222/136

[58] Field of Search ..... 222/1, 136, 145.1, 222/630, 637, 372, 383.1, 382, 145.5

[56] References Cited

U.S. PATENT DOCUMENTS

| | | | |
|---|---|---|---|
| 1,533,299 | 4/1925 | Armknecht . | |
| 2,246,211 | 6/1941 | Kilich . | |
| 2,612,403 | 9/1952 | Burch . | |
| 2,947,316 | 8/1960 | Walker . | |
| 2,986,162 | 5/1961 | Spexarth . | |
| 3,321,097 | 5/1967 | Solowey . | |
| 3,589,569 | 6/1971 | Bonetti . | |
| 4,132,361 | 1/1979 | Ryd . | |
| 4,217,054 | 8/1980 | Gacki et al. . | |
| 4,335,837 | 6/1982 | Bono . | |
| 4,370,998 | 2/1983 | Kimpara . | |
| 4,575,007 | 3/1986 | Groth et al. . | |
| 4,676,437 | 6/1987 | Brown . | |
| 4,790,454 | 12/1988 | Clark et al. . | |
| 4,823,829 | 4/1989 | Woods . | |
| 4,908,187 | 3/1990 | Holmquist et al. . | |
| 4,993,596 | 2/1991 | Brown . | |
| 5,033,649 | 7/1991 | Copeland et al. | 222/630 |
| 5,100,059 | 3/1992 | Englhard et al. . | |
| 5,255,820 | 10/1993 | Thomas . | |
| 5,259,557 | 11/1993 | Spriggs et al. . | |
| 5,344,074 | 9/1994 | Spriggs et al. . | |
| 5,372,129 | 12/1994 | Ryder . | |
| 5,372,310 | 12/1994 | Ketcham . | |
| 5,443,094 | 8/1995 | Olson et al. . | |
| 5,518,020 | 5/1996 | Nowicki et al. . | |
| 5,544,810 | 8/1996 | Horvath, Jr. et al. . | |
| 5,556,001 | 9/1996 | Weissman et al. . | |
| 5,584,327 | 12/1996 | Thomas et al. | 222/145.5 |
| 5,597,019 | 1/1997 | Thomas et al. . | |
| B1 4,217,054 | 6/1984 | Gacki et al. . | |

FOREIGN PATENT DOCUMENTS

| | | |
|---|---|---|
| 0 551 254 B1 | 4/1996 | European Pat. Off. . |
| H 105 97 | 5/1997 | Germany . |
| 2 297 306 | 7/1996 | United Kingdom . |

OTHER PUBLICATIONS

"Introducing! The Power Tool for Cleaning," S. C. Johnson & Son, Inc., Advertising Brochure, 8 pgs. (© 1997).

*Primary Examiner*—Philippe Derakshani
*Attorney, Agent, or Firm*—Merchant, Gould, Smith, Edell, Welter & Schmidt, P.A.

[57] ABSTRACT

A portable dispenser including a concentrate reservoir configured within the dispenser; a use-solution reservoir configured within the dispenser and positioned adjacent the concentrate reservoir; means connecting the concentrate reservoir and the use-solution reservoir, the connecting means providing for fluid flow between the concentrate reservoir and the use-solution reservoir; an inlet for introducing diluent into the dispenser; and means for generating a use-solution by drawing concentrate from the concentrate reservoir, whereby when a diluent is introduced into the dispenser inlet, the use-solution generating means is activated drawing concentrate from the concentrate reservoir and mixing the concentrate with the diluent to form a use-solution.

21 Claims, 7 Drawing Sheets

FLUID MIXING AND DISPENSING SYSTEM

FIELD OF THE INVENTION

The invention generally relates to dispensing systems for creating and discharging use-solutions to support cleaning in institutional environments. More specifically, the invention relates to portable dispensing systems that may be used with any source of diluent and that allow for the creation of a use-solution within the dispenser by refilling the dispenser with diluent.

BACKGROUND OF THE INVENTION

Hard surface cleaning in institutional environments has long been dependent on the transport, storage and discharge of cleaners from bulk supplies. Dispensing systems for use with these bulk cleaners can require a significant financial investment to install and maintain. Additionally, once installed these systems are usually fixed in place, adjacent to a water supply which is used to support application of the cleaner. The stationary system often requires the operator to create and dispense the cleaning solution at one location and then travel to another location at which the solution is used. The operator may then have to return to the dispensing system later to replenish the supply of cleaner. This can create inefficiency, especially in larger institutions having any number of sites requiring cleaning.

One solution is to use a portable dispenser and, to that end, several types of dispensing systems are known. The first type of dispensing system is a container with two or more compartments. Representative of these systems are Finch, U.K., Patent Application No. 2,297,306 and Solowey, U.S. Pat. No. 3,321,097. In Finch, the solution in the two compartments remain autonomous. In Solowey, there is some provision for flow between the compartments in the container. The next type of dispensing system is generally more complex involving some type of manifold or proportioning device to allow flow from reservoirs, or through intercirculation systems. All of Gacki et al., U.S. Pat. No. 4,217,054; Woods, U.S. Pat. No. 4,823,829; Nowicki et al., U.S. Pat. No. 5,518,020; and Copeland, EP 551,254 disclose these types of systems.

One further type of dispensing system includes that disclosed by Clark et al., U.S. Pat. No. 4,790,454 which teaches a concentrate containing vessel and a diluent containing vessel. Concentrate and diluent are drawn from each of these respective containers through the suction side of an electric pump and dispensed through means such as a hose having a check valve which can be controlled by a switch. Clark does not teach a use-solution container for mixing of diluent and concentrate. Rather, Clark et al., mixes diluent concentrate in line through an aspirator driven by an electric motor.

Spexarth, U.S. Pat. No. 2,986,162 discloses a fuel tank for a two cycle engine such as a motorcycle or motorboat. An oil tank is mounted within a gas tank. An oil pump is contained within the oil tank to dispense oil into the gas mixture as a piston reciprocates within the pump.

Olson et al., U.S. Pat. No. 5,443,094 also discloses a product dilution system. A concentrate is drawn from a fixed or portable unit. At the same time, diluent is dispensed into the use-solution container for mixing with the concentrate. The use-solution container may then be used to store the mixed product. In Olson et al., diluent is fed from off-site into the ultimate use-solution container. Additionally, the concentrate is also drawn into the storage container by the injection of diluent and mixing is undertaken in-line and within the use-solution container. Olson does not provide a portable dispenser including a use-solution reservoir. Rather transport of the Olson system requires moving the large solution reservoir.

As a result, there is a need for a portable dispensing system which creates and stores use-solution such as an institutional cleaner and which can be replenished adjacent any source of available diluent.

SUMMARY OF THE INVENTION

In accordance with a first aspect of the invention, there is provided a portable dispenser, comprising a concentrate reservoir configured within the dispenser; a use-solution reservoir configured within the dispenser and positioned adjacent the concentrate reservoir; means connecting the concentrate reservoir and the use-solution reservoir, the connecting means providing for fluid flow between the concentrate reservoir and the use-solution reservoir; an inlet for introducing diluent into the dispenser; and means for generating a use-solution by drawing concentrate from the concentrate reservoir, whereby when a diluent is introduced into the dispenser inlet, the use-solution generating means is activated drawing concentrate from the concentrate reservoir and mixing the concentrate with the diluent to form a use-solution.

The invention is a portable two compartment dispenser system. The upper compartment is a concentrate reservoir and the lower compartment is a use-solution reservoir. The dispenser may also have an external quick-connect to allow the flow of diluent into the dispenser, and an aspirator to mix concentrate and diluent to form a use-solution. There is hollow tubing connecting these two compartments and means for providing additional infusion of concentrate and diluent into the system. When the use-solution in the lower reservoir is exhausted, diluent from an external source may be introduced into the dispenser. As the diluent flows past the aspirator, concentrate is drawn into the flow and mixed with the diluent to form a use-solution.

The dispenser is portable, allowing for its use with any water source. Generally, the dispenser may weigh from about 15 to 25 pounds when full. The dispenser also does not require any electrical power source. An external water source is all that is necessary to generate a use-solution. The use-solution may then be dispensed by gravity flow. The invention also provides a discrete reservoir for both the concentrate and use-solution making the transport of large volumes of diluent unnecessary.

The design and operation of the dispenser of the invention, that is not requiring a dedicated direct water connection, minimizes installation and service requirements. Product dilution may be delivered by a quick connecting water gun which, when attached to the dispenser, aspirates the product concentrate from an upper chamber into the lower chamber. The dispenser of the invention may also comprise backflow prevention by means such as an air gap which prevents the diluent flow from reversing and contaminating the diluent source.

The unique simplicity of the dispenser of the invention also reduces the field installation and service maintenance required to support the system. The dispenser may be made of lightweight and durable materials to assist in portability. The dispenser may also be configured to meet domestic and international plumbing codes. Refilling of the dispenser may be completed by a faucet mounted water gun having a quick connect to the dispensing unit.

DETAILED DESCRIPTION OF THE PREFERRED EMBODIMENT

Figure 3:
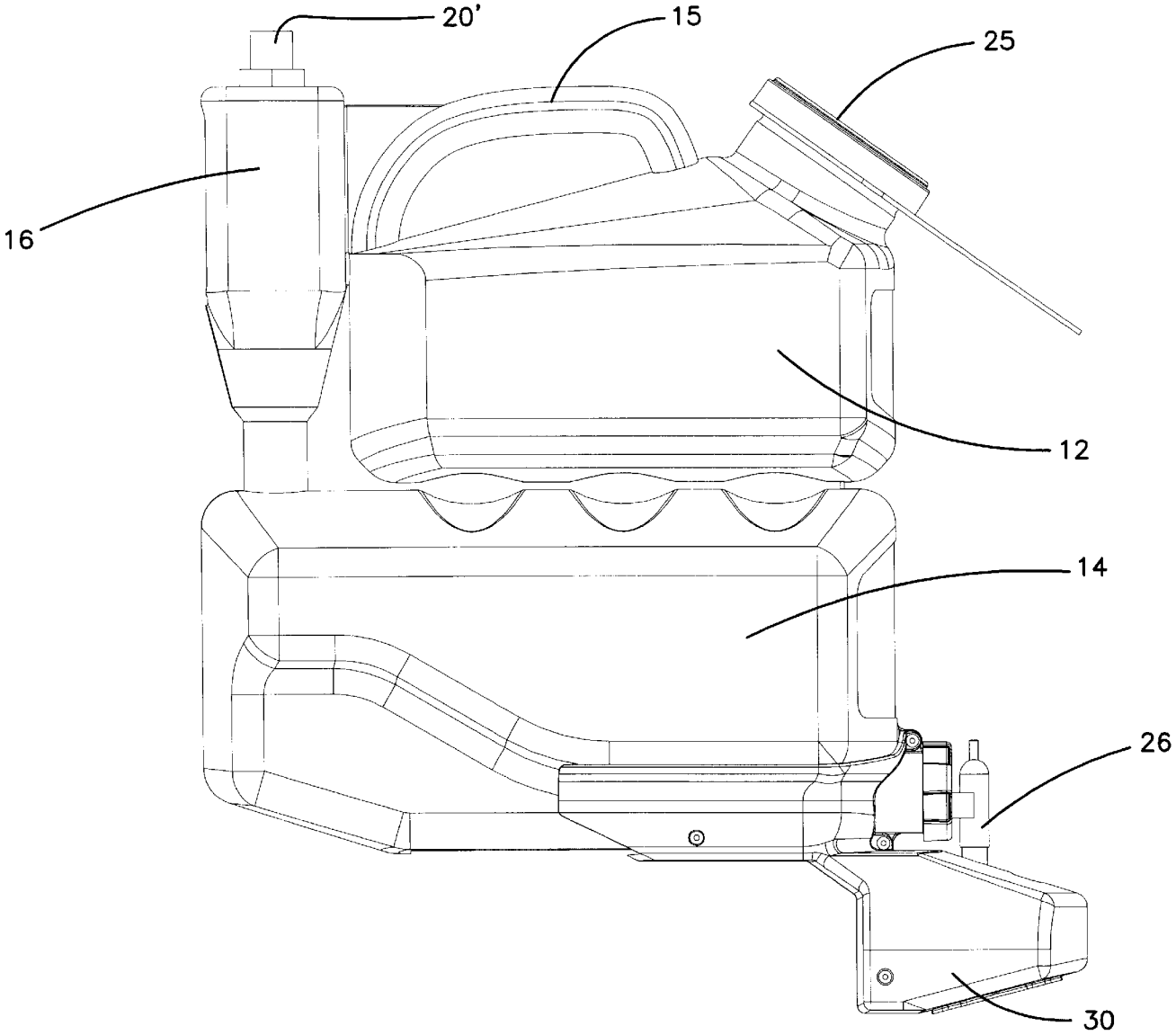
FIG. 3 is a side elevation of the dispenser depicted in FIG. 1.

Turning to FIGS. 1 through 6, wherein like parts are designated with the same numeral throughout the views presented in these Figures, there is shown a portable dispenser 10. The dispenser comprises a concentrate reservoir 12 configured within the dispenser 10. The dispenser also comprises a use-solution reservoir 14 positioned adjacent the concentrate reservoir 12, FIG. 1A. The dispenser may further comprise a handle 15 (FIGS. 1A and 3). The concentrate reservoir 12 generally comprises the upper portion of the dispenser 10 and the use-solution reservoir 14 comprises the lower portion of the dispenser 10, FIGS. 2 and 3.

The dispenser 10 may also include means connecting the concentrate reservoir 12 and the use-solution reservoir 14. The reservoir connecting means is generally configured in housing 16 and provides for fluid flow between the concentrate reservoir 12 and the use-solution reservoir 14. The connecting means generally comprises one or more tubes. The use-solution generating means 18 such as an aspirator, is in fluid connection with these hollow tubes and means for generating a use-solution.

Figure 4:
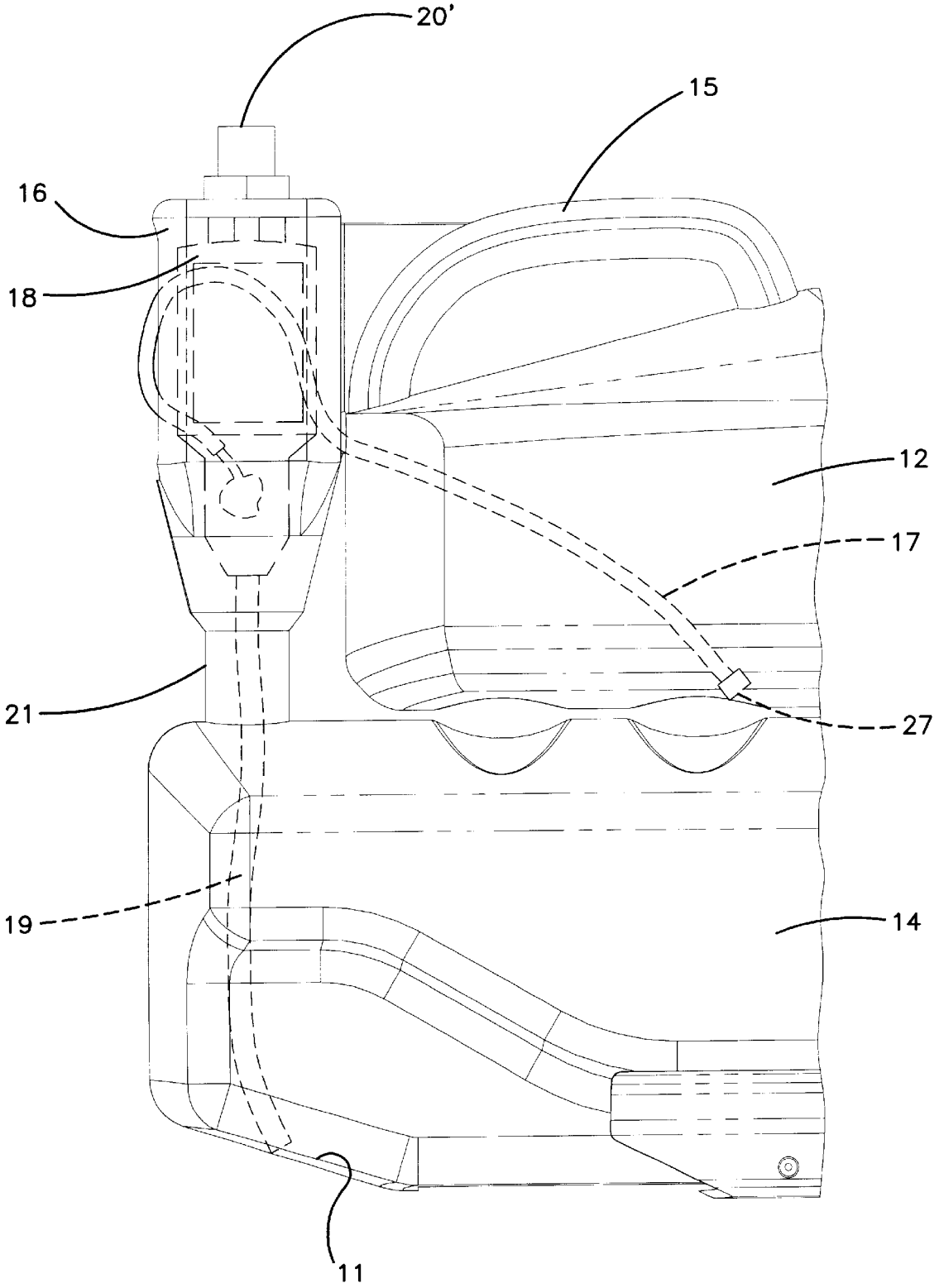
FIG. 4 is a partially cutaway side elevation of the dispensing system depicted in FIG. 1.
Figure 5:
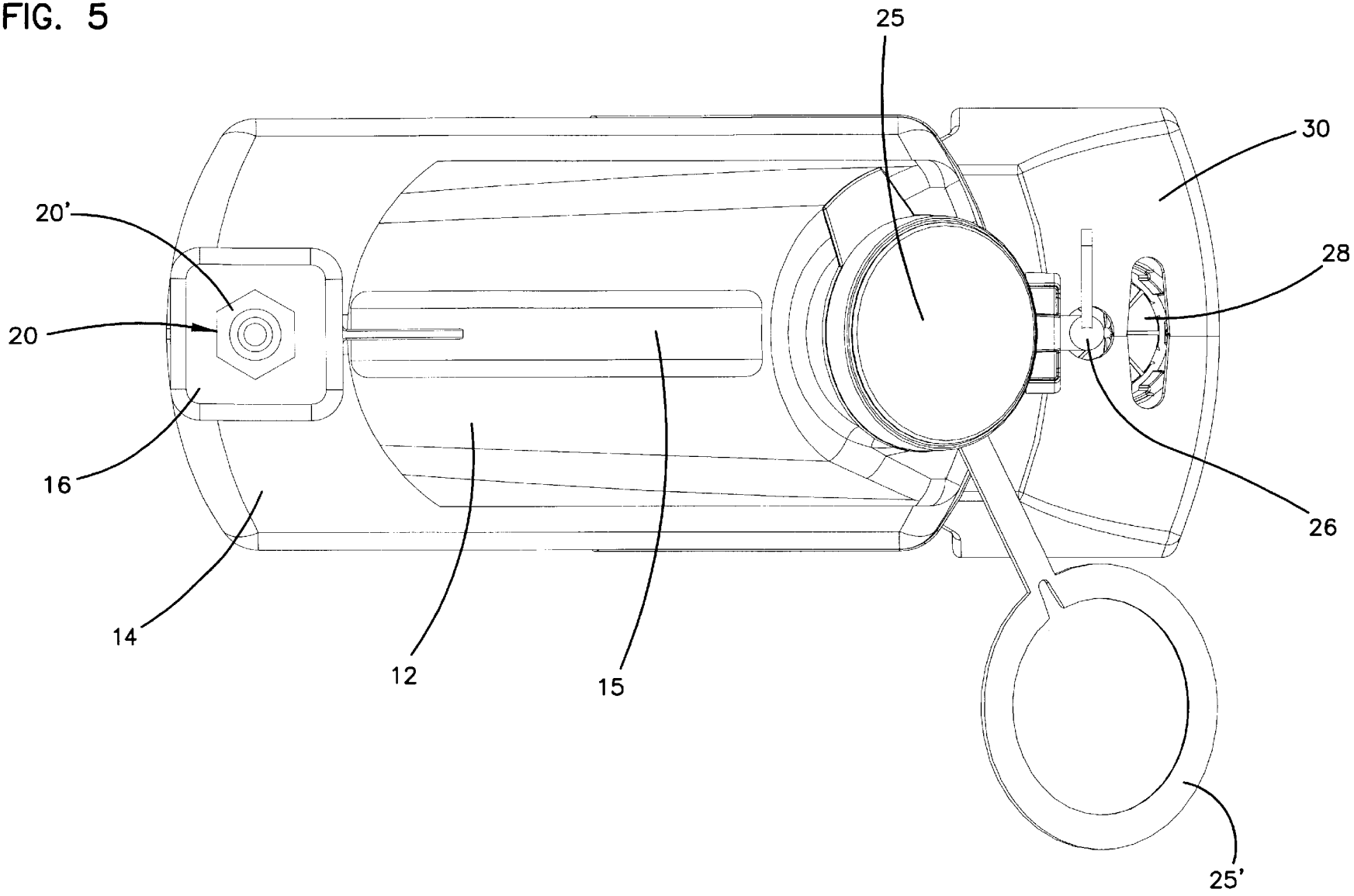
FIG. 5 is a perspective view showing the top of the dispenser depicted in FIG. 1.
Figure 6:
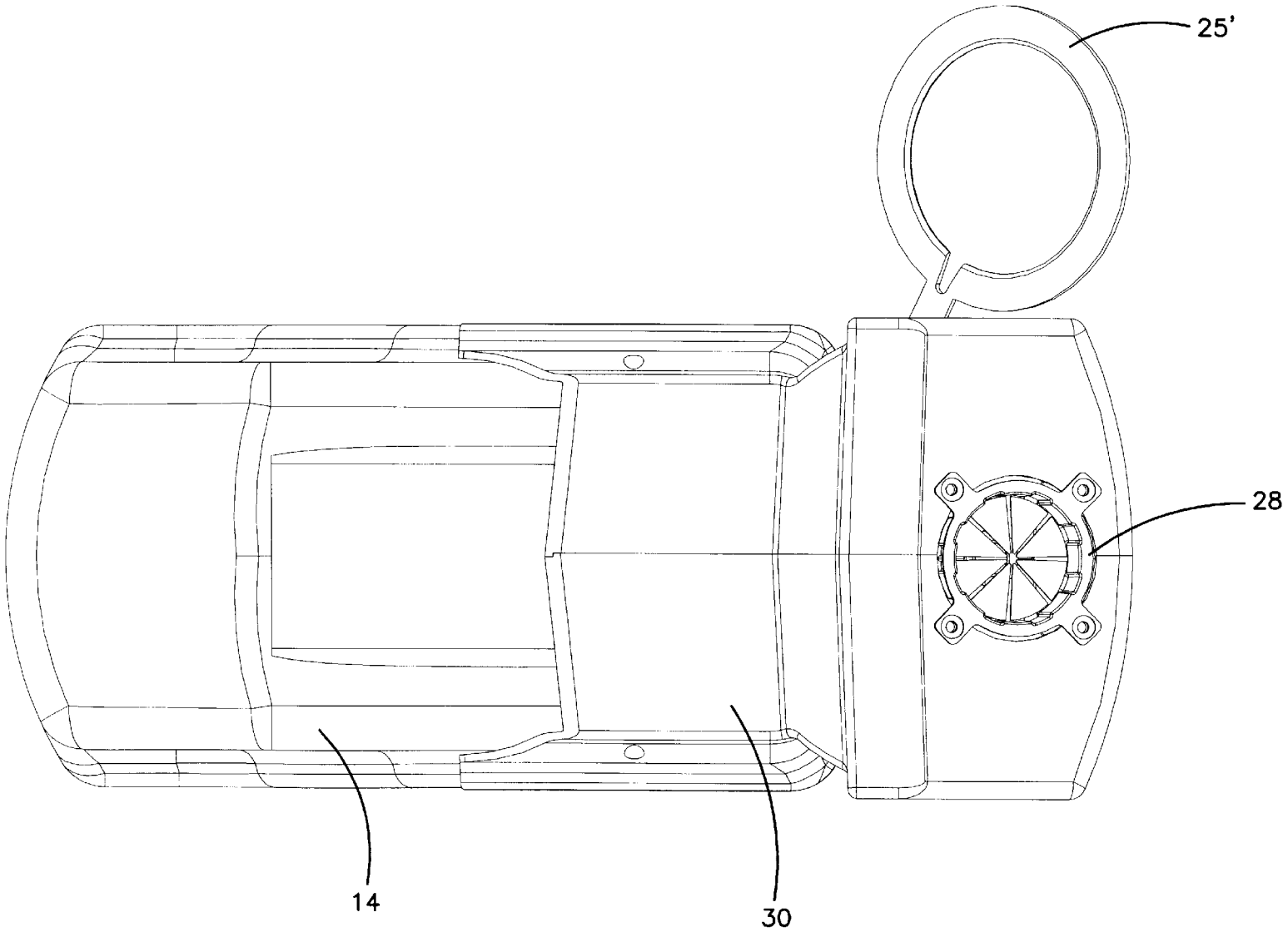
FIG. 6 is a perspective view showing the bottom of the dispenser depicted in FIG. 1.

As can be seen in FIG. 4, tube 17 runs from the concentrate reservoir to the use-solution generating means 18 with tube 19 returning to the use-solution reservoir 14. In order to prevent clogging, keep the concentrate pickup tube 17 filled, and in order to insure even flow, tube 17 may have a valve 27 attached to the end of the tube which is positioned in the concentrate reservoir 12, FIG. 4.

Additionally, use-solution discharge tube 19 runs into use-solution reservoir 14 through tube 21. Generally, tube 21 may be formed as part of the dispenser 10. Making tube 21 larger in diameter than discharge tube 19 allows for air to escape from use-solution reservoir 14 as use-solution is discharged into the reservoir 14, FIG. 4. In turn, this prevents the build up of back pressure in discharge tube 19 and the flow of use-solution back into aspirator 18. Preferably, the use-solution generating means 18 comprises an air gap which functions to prevent the back flow of use-solution and concentrate to, and out of, the dispenser inlet 20.

The dispenser also includes an inlet 20 for introducing diluent into the dispenser adjacent the means 18 for generating a use-solution. The use-solution generating means 18 generally comprises an aspirator, which is generally configured outside of the concentrate reservoir 12 and the use-solution reservoir 14, FIGS. 1A and 4. When diluent is introduced into the dispenser inlet 20, the use-solution generating means 18 is activated drawing concentrate from the concentrate reservoir 12 and mixing the concentrate with the diluent to form a use-solution which is deposited in the use-solution reservoir 14.

The dispenser 10 may also comprise refilling means 22 for the concentrate reservoir. The refilling means 22 may, in turn, comprise identification means such as a geometrically patterned lockout 24, FIG. 1A. The dispenser use-solution reservoir 14 may comprise a spout 26 which, in turn, may also comprise similar identification or lockout means 28, FIG. 2. This allows bottles useful in providing concentrate to the dispenser to also be used to carry use solution once formulated.

The concentrate reservoir 12 and the use-solution reservoir 14 may also comprise materials which are either translucent or transparent. This allows the operator to determine the relative volume of concentrate and use-solution remaining in either reservoir. A stationary of fixed scale 32 and 34 may also be placed on the face of either reservoir to provide a more absolute measure of the volume of solution remaining, see FIG. 2.

In operation of the dispenser 10, the concentrate reservoir 12 generally functions to hold and discharge any composition which may be diluted before use through the functioning of the dispenser. To this end, the dispenser may have any number of configurations. Generally, the concentrate reservoir 12 comprises a volume large enough to hold an economically efficient amount of concentrate for later dilution.

Concentrate may be placed into concentrate reservoir 12 through opening 22 or any similarly configured means of refilling this reservoir. In turn, the opening may be protected from refilling with the incorrect concentrate by means such as insert 23 and lockout 24. Use of lockout 24 requires that any container used to dispense concentrate into the concentrate reservoir 12 would have to have a pattern which would fit the geometric design on the interior perimeter of lockout 24. As depicted in FIG. 1 A, lockout 24 has a hexagonal pattern.

Any number of patterns may be used in lockout 24 to facilitate use of concentrates and other compositions. Representative patterns include the hexagonal pattern shown in FIG. 1A as well as circular patterns, fourpoint cross patterns, and six point cross patterns, among others. To prevent spillage and contamination, the concentrate reservoir 12 may have a cap 25, FIG. 1A. When in use, cap 25 may be secured over refilling means 22. When the concentrate reservoir 12 is open, the cap 25 may be secured to the container by loop 25' which is fixed around refilling means 22.

Figure 1A:
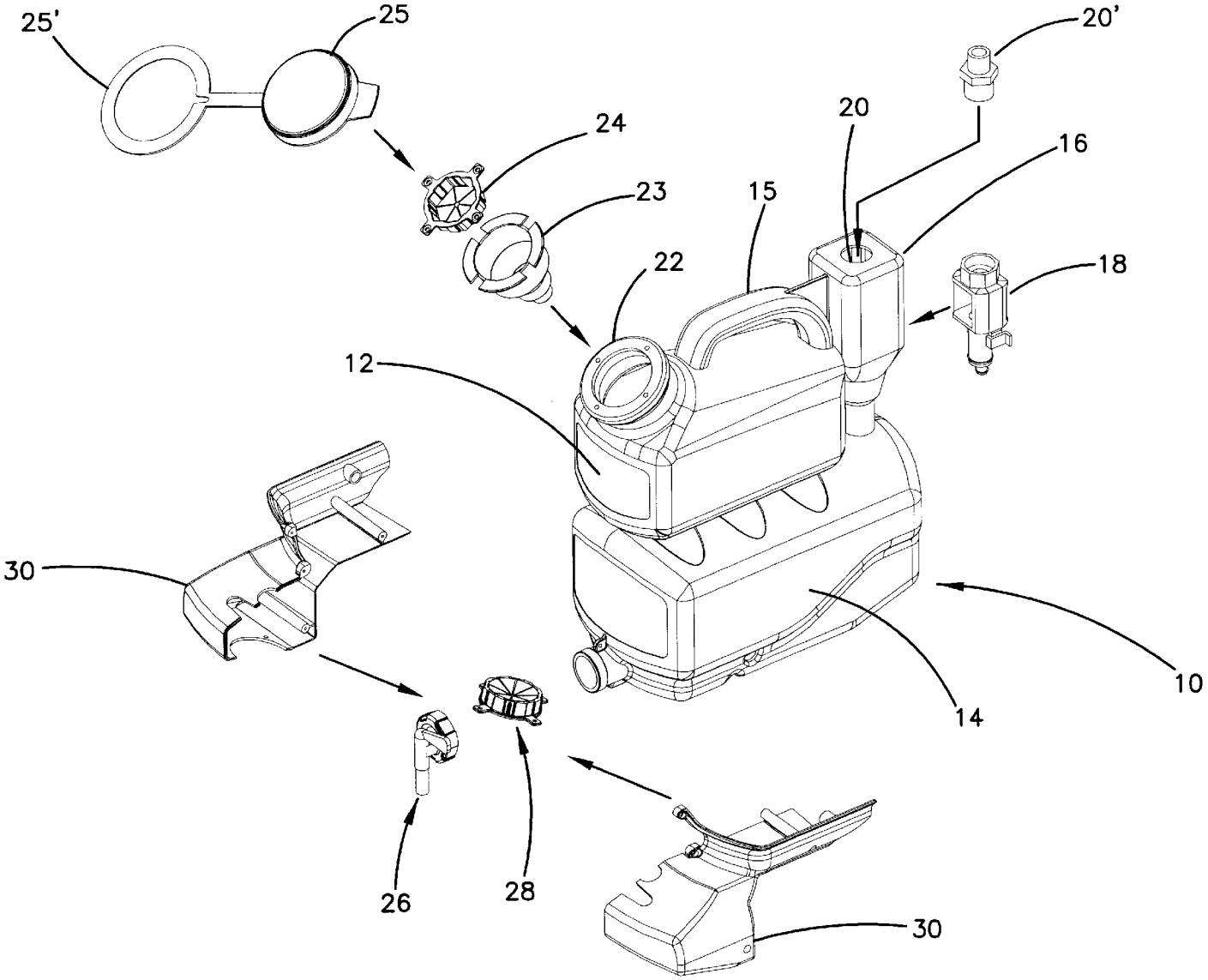
FIG. 1A is an exploded perspective view of one embodiment of a dispensing system in accordance with a preferred aspect of the invention.
Figure 1B:
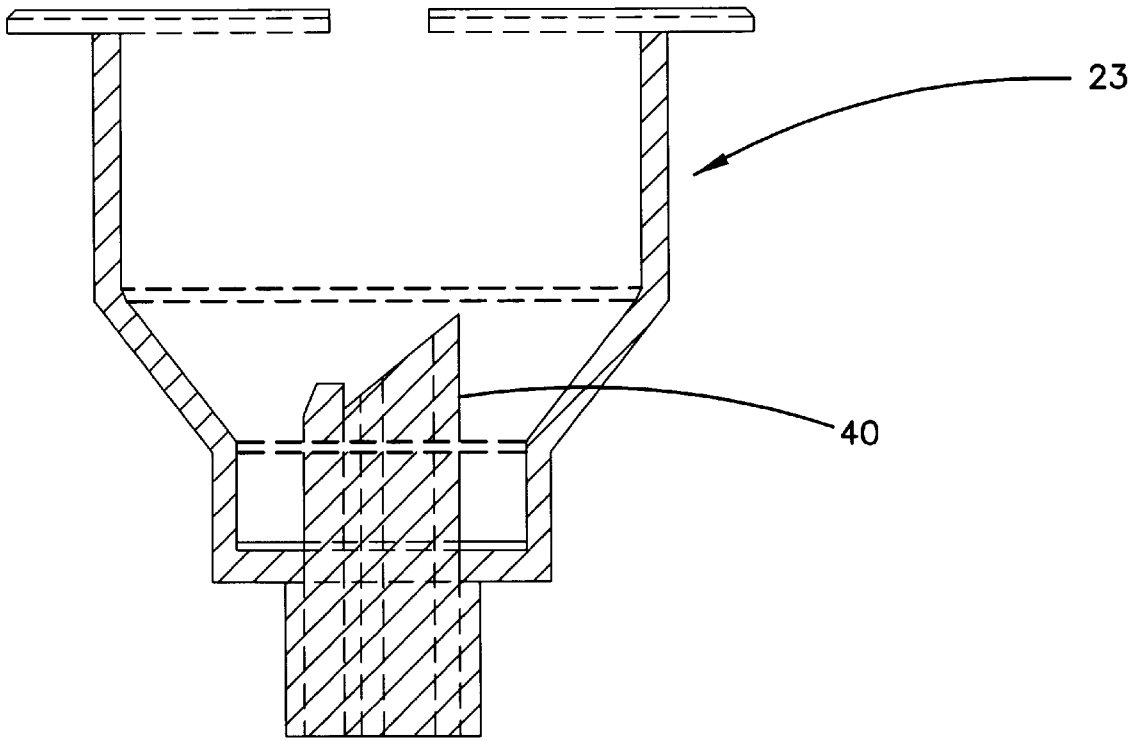
FIG. 1B is a side cutaway elevation of the insert shown in FIG. 1A.
Figure 2:
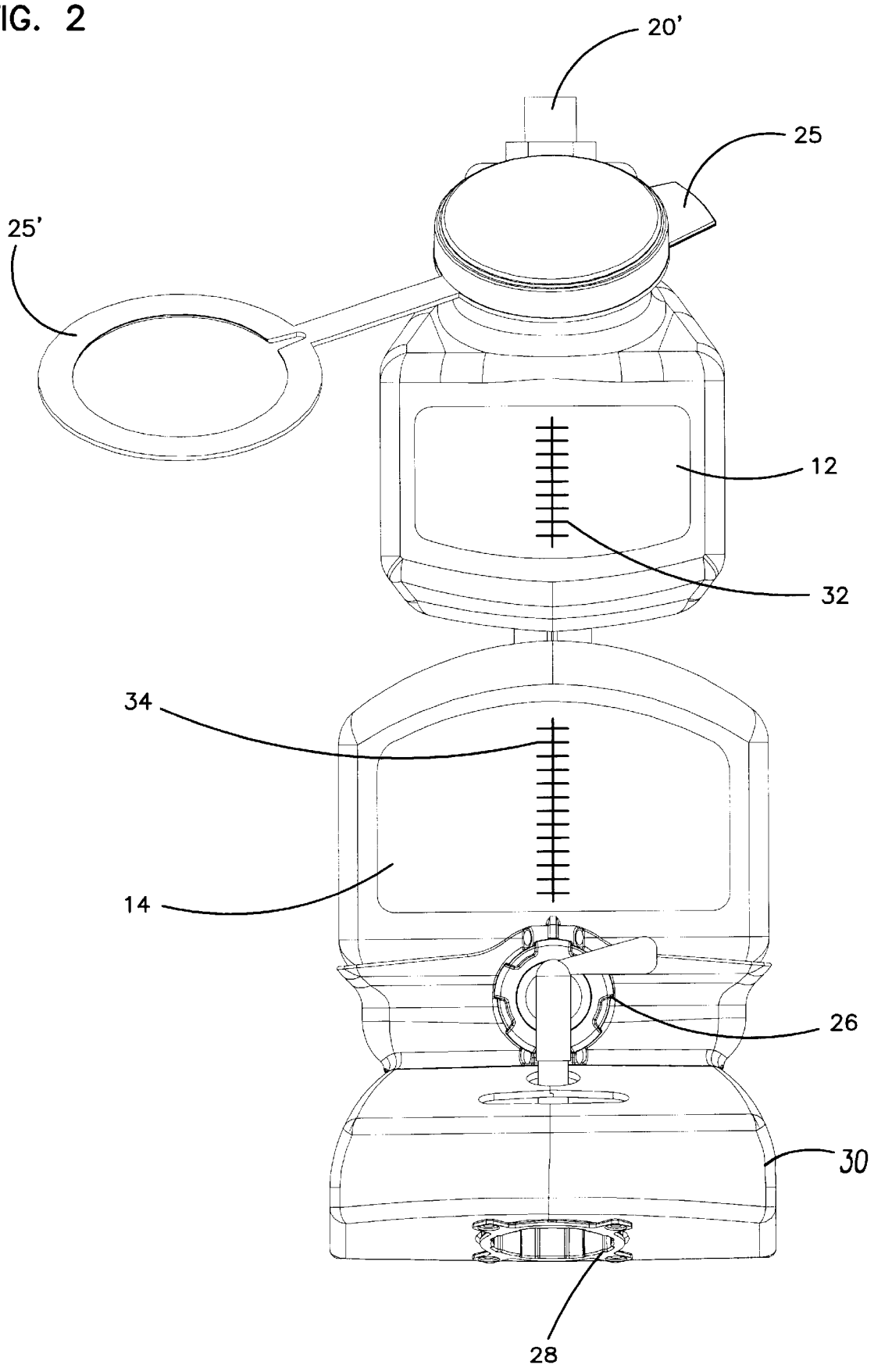
FIG. 2 is a front elevation of the dispenser depicted in FIG. 1.

If sealed, the concentrate container may be opened by puncturing means 40 configured within insert 23, FIG. 1B before the concentrate is dispensed into reservoir 12. The puncturing means 40 may be configured with a central opening to allow concentrate flow through the insert 23 into reservoir 12. In this manner, a sealed concentrate container may be coded by lockout 24 to a specific dispenser, opened by piercing means 40 and drained into the concentrate reservoir 12. The same concentrate container may be coded to the use solution reservoir 14 by lower lockout 28, and then the container may be filled with use solution. Other dispensing lockout systems which may be used in the invention include those disclosed in U.S. Pat. No. 5,597,019 which is incorporated herein by reference.

The dispenser also comprises means for drawing concentrate from the concentrate reservoir 12, mixing this concentration with a diluent, and discharging the concentrate into the use-solution reservoir 14. Any means known to those of skill in the art may be used including aspirators which have air gap backflow prevention. As can be seen, (FIG. 4), an aspirator 18 is configured within housing 16. A dispenser inlet 20 is attached through housing 16 to aspirator 18. The dispenser inlet 20 also comprises a locknut 20' which holds the aspirator 18 within housing 16. The dispenser inlet has an orifice which allows for the insertion of additional diluent into the dispenser 10 by inserting diluent through the orifice into the aspirator 18.

Once activated, the aspirator 18 draws concentrate form the concentrate reservoir 12 through a tube 17, (see FIG. 4) and mixing the concentrate with the diluent to create the use-solution which is discharged into use-solution 14 reservoir through discharge tube 19.

In use, the dispenser may be taken to any number of any available water sources for the generation of additional use-solution. Aspirators such as those disclosed in U.S. Pat. No. 5,518,020 to Nowicki et al., and assigned to Dema Engineering Co. and incorporated herein by reference may be used by the aspirator 18. These aspirators have metering rates which are easily set to allow for various dilutions of concentrate and diluent.

In order to allow for proper diluent flow from the concentrate reservoir 12 through the aspirator 18 into the use-solution reservoir 14, any variety of hosing may be used. Hoses 17 and 19 may be used for this function, FIG. 4. Optionally, these hoses may be formed into the dispenser during the construction of the dispenser 10 by means such as blow molding.

The use-solution reservoir 14 is generally configured to contain an efficiently practical amount of use-solution for given application. An advantage of the invention is the ability of the operator to dispense use-solution at any number of locations regardless of the presence of a dedicated diluent source such as a water source.

To this end, the use-solution reservoir may be of appropriate size and volume to contain the requisite amount of use-solution after its creation, explained above. Additionally, means may be provided to ease and expedite the discharge of use-solution from the use-solution reservoir. For example, the bottom surface 11 of the use-solution may be angled to prevent the pooling of use-solution in the back portion of the reservoir 14.

To monitor and regulate the use-solution discharge means such as a spout 26 and an additional lockout 28 may be contained within face plate 30. Lockout 28 functions similarly to lockout 24 by preventing the unintentional mixing of chemicals.

Even though numerous characteristics and advantages of the invention have been set forth in the foregoing description, together with the details of the structure and function of the invention, the disclosure is illustrative only, and changes may be made in details especially in matters of shape, size, and arrangement of parts, within the principles of the invention, to the full extent indicated by broad general meaning of the appending claims.

The claimed invention is:

1. A portable dispenser, said dispenser comprising:

(a.) a concentrate reservoir configured within said dispenser;

(b.) a use-solution reservoir configured within said dispenser and positioned adjacent said concentrate reservoir;

(c.) means connecting said concentrate reservoir and said use-solution reservoir, said connecting means providing for fluid flow between said concentrate reservoir and said use-solution reservoir;

(d.) an inlet for introducing diluent into said dispenser; and (e.) means for generating a use-solution by drawing concentrate from said concentrate reservoir, whereby when a diluent is introduced into said dispenser inlet, said use-solution generating means is activated drawing concentrate from said concentrate reservoir and mixing the concentrate with the diluent to form a use-solution.

2. The dispenser of claim 1, wherein said concentrate reservoir comprises refilling means.

3. The dispenser of claim 2, wherein said refilling means comprises identification means.

4. The dispenser of claim 1, wherein said use-solution reservoir comprises a spout.

5. The dispenser of claim 4, wherein said use-solution reservoir spout comprises identification means.

6. The dispenser of claim 1, wherein said use-solution generating means comprises an aspirator which is configured outside of said concentrate reservoir and said use-solution reservoir.

7. The dispenser of claim 6, wherein said aspirator comprises an air-gap.

8. The dispenser of claim 7, wherein said connecting means comprises a tube.

9. The dispenser of claim 1, wherein said dispenser further comprises a handle, said concentrate reservoir comprises the upper portion of said dispenser, and said use-solution reservoir comprises the lower portion of said dispenser.

10. The dispenser of claim 1, wherein said connecting means comprises one or more hollow tubes capable of providing fluid flow between said concentrate reservoir and said use-solution reservoir, said generating means comprising an aspirator in fluid connection with said connecting means.

11. The dispenser of claim 10, wherein said concentrate reservoir comprises a material which is translucent or transparent.

12. The dispenser of claim 10, wherein said use-solution reservoir comprises a material which is translucent or transparent.

13. The dispenser of claim 1, wherein said concentrate reservoir is replenishable.

14. The dispenser of claim 6, wherein said aspirator is enclosed within said dispenser.

15. The dispenser of claim 1, wherein said connecting means is molded into said dispenser.

16. The dispenser of claim 1, wherein said use-solution reservoir comprises a bottom which is angled to facilitate dispensing of said use-solution.

17. The dispenser of claim 6, wherein said aspirator comprises a metering tip.

18. The dispenser of claim 6, wherein said connecting means comprises a first hose connecting said concentrate reservoir and said aspirator and a second hose connecting said aspirator and said use-solution reservoir.

19. The dispenser of claim 1, wherein said use-solution reservoir has a vent.

20. The dispenser of claim 19, wherein said first hose comprises a foot valve.

21. A method of dispensing a fluid use-solution using a portable dispenser, said dispenser comprising: a concentrate reservoir configured within said dispenser; a use-solution reservoir configured within said dispenser and positioned adjacent said concentrate reservoir; means connecting said concentrate reservoir and said use-solution reservoir, said connecting means providing for fluid flow between said concentrate reservoir and said use-solution reservoir; an inlet for introducing diluent into said dispenser; and means for generating a use-solution by drawing concentrate from said concentrate reservoir, whereby when a diluent is introduced into said dispenser inlet, said use-solution generating means is activated drawing concentrate from said concentrate reservoir and mixing the concentrate with the diluent to form a use-solution, said method comprising the steps of:

(a.) injecting diluent into said dispenser to create a use-solution; and (b.) dispensing the use-solution.

* * * * *

UNITED STATES PATENT AND TRADEMARK OFFICE

CERTIFICATE OF CORRECTION

PATENT NO. : 5,941,416
DATED : August 24, 1999
INVENTOR(S) : Balz et al.

It is certified that error appears in the above-identified patent and that said Letters Patent is hereby corrected as shown below:

Please replace the formal drawings shown in the patent (FIGS.2- 6) with the correct formal drawings attached (FIGS. 2-6) hereto.

Signed and Sealed this

Eighteenth Day of September, 2001

*Attest:*

Nicholas P. Godici

NICHOLAS P. GODICI

*Attesting Officer*

*Acting Director of the United States Patent and Trademark Office*